US007663552B2

(12) United States Patent
Mei

(10) Patent No.: US 7,663,552 B2
(45) Date of Patent: Feb. 16, 2010

(54) PRINTED ANTENNA

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 258 days.

(21) Appl. No.: 11/944,419

(22) Filed: Nov. 22, 2007

(65) Prior Publication Data

US 2008/0158067 A1 Jul. 3, 2008

(30) Foreign Application Priority Data

Dec. 29, 2006 (CN) ..... 2006 1 0064631

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,052,889 A * 4/2000 Yu et al. ..... 29/600
7,079,077 B2 * 7/2006 Lee ..... 343/700 MS
2005/0062671 A1 * 3/2005 Berezin et al. ..... 343/846

FOREIGN PATENT DOCUMENTS

CN 1591972 3/2005

* cited by examiner

*Primary Examiner*—HoangAnh T Le
(74) *Attorney, Agent, or Firm*—Frank R. Niranjan

(57) ABSTRACT

A printed antenna (10) disposed on a substrate (90) includes a feeding portion (12), an antenna body (16), a first grounded portion (20), a second grounded portion (30), and a matching portion (14). The feeding portion feeds electromagnetic signals. The antenna body electronically connected to the feeding portion transmits and receives electromagnetic signals, and includes a first radiation portion (162), a pair of second radiation portions (164), and a pair of third radiation portions (166). The first radiation portion, the second radiation portions, and the third radiation portions co-form, a "D" shape with an indentation in a straight side of the "D" shape which extends into a middle of the "D" shape. The first grounded portion and the second grounded portion are respectively disposed on opposite sides of the feeding portion. The matching portion is disposed on one side of the feeding portion, and located adjacent to the first grounded portion.

20 Claims, 7 Drawing Sheets

PRINTED ANTENNA

BACKGROUND OF THE INVENTION

1. Field of the Invention

The present invention relates to antennas, and particularly to a printed antenna used in wireless communication devices.

2. Description of Related Art

WiMAX is defined as Worldwide Interoperability for Microwave Access by the WiMAX Forum, formed in June 2001 to promote conformance and interoperability of the IEEE 802.16 standard, officially known as Wireless Metropolitan Area Network (WMAN). The Forum describes WiMAX as "a standards-based technology enabling the delivery of last mile wireless broadband access as an alternative to cable and digital subscriber line (DSL)". WiMAX is approved to be operated at 3.5 GHz.

In a wireless communication device, the antenna is a necessary element for radiating and receiving radio frequency signals, and thereby reducing the size of the antenna is one solution for reducing the size of the wireless communication device. A conventional improved biconical antenna can increase the bandwidth, but has a larger size. Therefore, what is needed is a WiMAX antenna with a smaller size, better bandwidth, and better performance.

SUMMARY OF THE INVENTION

One aspect of the present invention provides a printed antenna. The printed antenna disposed on a substrate includes a feeding portion, an antenna body, a first grounded portion, a second grounded portion, and a matching portion. The feeding portion feeds electromagnetic signals. The antenna body, electronically connected to the feeding portion, transmits and receives electromagnetic signals. The antenna body includes a first radiation portion, a pair of second radiation portions, and a pair of third radiation portions. Each second radiation portion connects one of the third radiation portions to the first radiation portion, respectively. Two free ends of the pair of third radiation portions face each other. The first radiation portion, the pair of second radiation portions, and the pair of third radiation portions co-form a "D" shape, with an indentation in a straight side of the "D" shape which extends into a middle of the "D" shape. The first grounded portion and the second grounded portion are disposed on opposite sides of the feeding portion, respectively. The matching portion is disposed on one side of the feeding portion, and located adjacent to the first grounded portion.

Other advantages and novel features will become more apparent from the following detailed description when taken in conjunction with the accompanying drawings, in which:

DETAILED DESCRIPTION OF THE INVENTION

Figure 1:
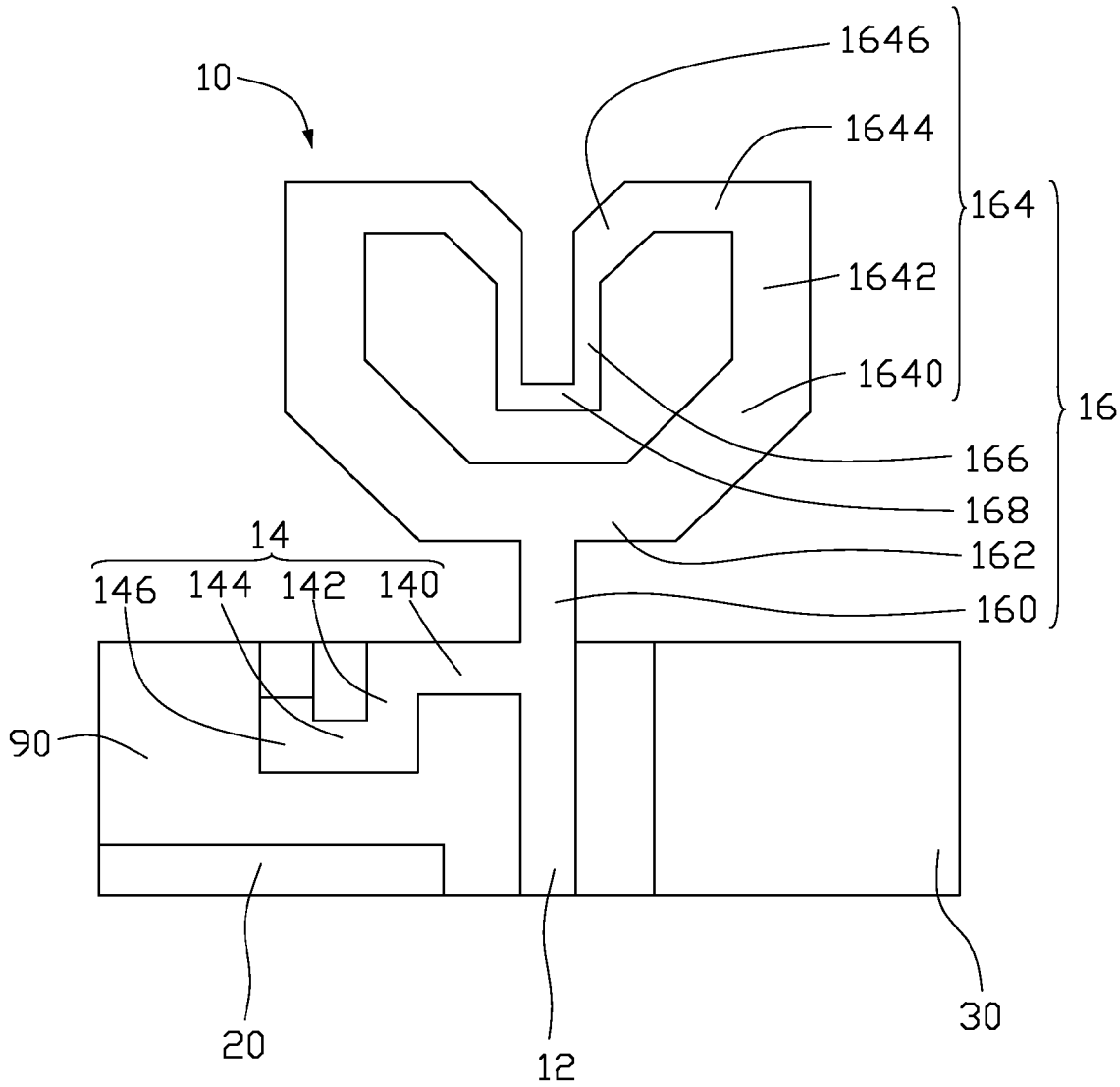
FIG. 1 is a schematic diagram of a printed antenna of an exemplary embodiment of the present invention.

FIG. 1 is a schematic diagram of a printed antenna 10 of an exemplary embodiment of the present invention. In the exemplary embodiment, the printed antenna 10 disposed on a substrate 90 includes a feeding portion 12, a matching portion 14, an antenna body 16, a first grounded portion 20, and a second grounded portion 30.

The feeding portion 12, the matching portion 14, the antenna body 16, the first grounded portion 20, and the second grounded portion 30 are all disposed on a same surface of the substrate 90. In another embodiment, the printed antenna 10 may further include a grounded metal plane disposed on another surface of the substrate 90 opposite to the surface that the first grounded portion 20 and the second grounded portion 30 are disposed on.

The feeding portion 12 is used for feeding electromagnetic signals. In the exemplary embodiment, the feeding portion 12 is a 50 ohm transmission line. The first grounded portion 20 and the second grounded portion 30 are disposed on opposite sides of the feeding portion 12 respectively. A length of the first grounded portion 20 is smaller than that of the second grounded portion 30 along the feeding portion 12.

The antenna body 16 is connected to the feeding portion 12, for transmitting and receiving electromagnetic signals. In the exemplary embodiment, the antenna body 16 is generally "D"-shaped, with an indentation in the straight side of the "D" shape which extends into a middle of the "D" shape. That is, the antenna body 16 is hollow. All sides of the antenna 16 are rectilinear. The antenna body 16 is symmetrical, with an axis of symmetry of the antenna body 16 coinciding with a central axis of the indentation. The antenna body 16 includes a connection portion 160, a first radiation portion 162, a pair of second radiation portions 164, a pair of third radiation portions 166, and a fourth radiation portion 168. The pair of second radiation portions 164 connects the pair of third radiation portions 166 to the first radiation portion 162, respectively. Two ends of the fourth radiation portion 168 are connected to the pair of third radiation portions 166, respectively. The first radiation portion 162, the pair of second radiation portions 164, the pair of third radiation portions 166, and the fourth radiation portion 168 co-form a "D" shape, with an indentation in the straight side of the "D" shape which extends into a middle of the "D" shape. In other word, these radiation portions together define a pair of hollow ear-like members each of which is symmetrical to the other relative to the feeding portion 12, and the pair of hollow ear-like members is connected by the first radiation portion 162 and the fourth radiation portion 168 respectively. One end of the connection portion 160 is electronically connected at a straight angle to the feeding portion 12, and the other end of the connection portion 160 is connected at a right angle to the substantial center of the first radiation portion 162. That is, the connection portion 160 and the feeding portion 12 are in a line, and the connection portion 160 is perpendicular to the first radiation portion 162.

In the exemplary embodiment, the second radiation portions 164 are symmetrical to each other along an extending line of the feeding portion 12 and the connection portion 160. The third radiation portions 166 are also symmetrical to each other along the extending line of the feeding portion 12 and the connection portion 160. Each second radiation portion 164 includes a first radiation segment 1640, a second radiation segment 1642, a third radiation segment 1644, and a fourth radiation segment 1646 connected in sequence. In the exemplary embodiment, the first radiation segment 1640 is parallel to the fourth radiation segment 1646, and the second radiation segment 1642 is perpendicular to the third radiation segment 1644. An angle between the first radiation segment 1640 and the second radiation segment 1642 and an angle between the third radiation segment 1644 and the fourth radiation segment 1646 are both substantially 135 degrees.

The first radiation segments 1640 of the second radiation portions 164 are electronically connected to two ends of the first radiation portion 162 respectively, and the angle between each first radiation segment 1640 and the first radiation portion 162 is substantially 135 degrees.

The third radiation portions 166 face each other, and are parallel to each other. One end of each third radiation portion 166 is connected to the second radiation portion 164, and the other end of the third radiation portion 166 is connected to the fourth radiation portion 168. Each third radiation portion 166 extends from the fourth radiation segment 1646 of the second radiation portion 166 to the first radiation portion 162. The third radiation portions 166 are both perpendicular to the fourth radiation portion 168. An angle between the third radiation portion 166 and the fourth radiation segment 1646 of the second radiation portion 164 is substantially 135 degrees.

The matching portion 14 is disposed on one side of the feeding portion 12, and located adjacent to the first grounded portion 20, for impedance matching. The matching portion 14 includes a first matching segment 140, a second matching segment 142, a third matching segment 144, and a fourth matching segment 146 electronically connected in sequence. In the exemplary embodiment, the first matching segment 140 is parallel to the third matching segment 144, the second matching segment 142 is parallel to the fourth matching segment 146, and the second matching segment 142 and the fourth matching segment 146 are perpendicular to the first matching segment 140 and the third matching segment 144. The first matching segment 140 is electronically connected at a right angle to the feeding portion 12.

In the exemplary embodiment, the connection portion 160, the first matching segment 140, the second matching segment 142, the third matching segment 144, the fourth matching segment 146, and the fourth radiation portion 168 are all rectangular-shaped. The first radiation portion 162, the third radiation portion 166, the first radiation segment 1640, the second radiation segment 1642, the third radiation segment 1644, and the fourth radiation segment 1646 are all trapezoid-shaped.

In the exemplary embodiment, the connection portion 160 is substantially 2.0 mm long, and 1.0 mm wide. A top length of the first radiation portion 162 is substantially 3.0 mm, a bottom length of the first radiation portion 162 is substantially 5.0 mm, and a height of the first radiation portion 162 is 1.5 mm. A top length of the first radiation segment 1640 is substantially 2.8 mm, a bottom length is substantially 3.5 mm, and a height of the first radiation segment 1640 is 1.5 mm. The top length of the second radiation segment 1642 is substantially 2.5 mm, the bottom length is substantially 3.5 mm, and the height is 1.5 mm. The top length of the third radiation segment 1644 is substantially 3.0 mm, the bottom length is substantially 3.5 mm, and the height is 1.0 mm. The top length of the fourth radiation segment 1646 is substantially 1.4 mm, the bottom length is substantially 1.4 mm, and the height is 1.0 mm. The top length of the third radiation portion 166 is substantially 2 mm, the bottom length is substantially 3 mm, and the height is 0.5 mm. The fourth radiation portion 168 is substantially 2.0 mm long, and 0.5 mm wide. The distance between the third radiation portions 166 is substantially 1.0 mm.

The first matching segment 140 is substantially 2.0 mm long, and 1.0 mm wide. The second matching segment 142 is substantially 1.5 mm long and 1.0 mm wide. The third matching segment 144 is substantially 2.0 mm long and 1.0 mm wide. The fourth matching segment 146 is substantially 2.5 mm long and 1.0 mm wide.

In another exemplary embodiment, the matching portion 14 may be in a line and rectangular-shaped. The matching portion 14 may be substantially 6.0 mm and 1.0 mm.

Figure 2:
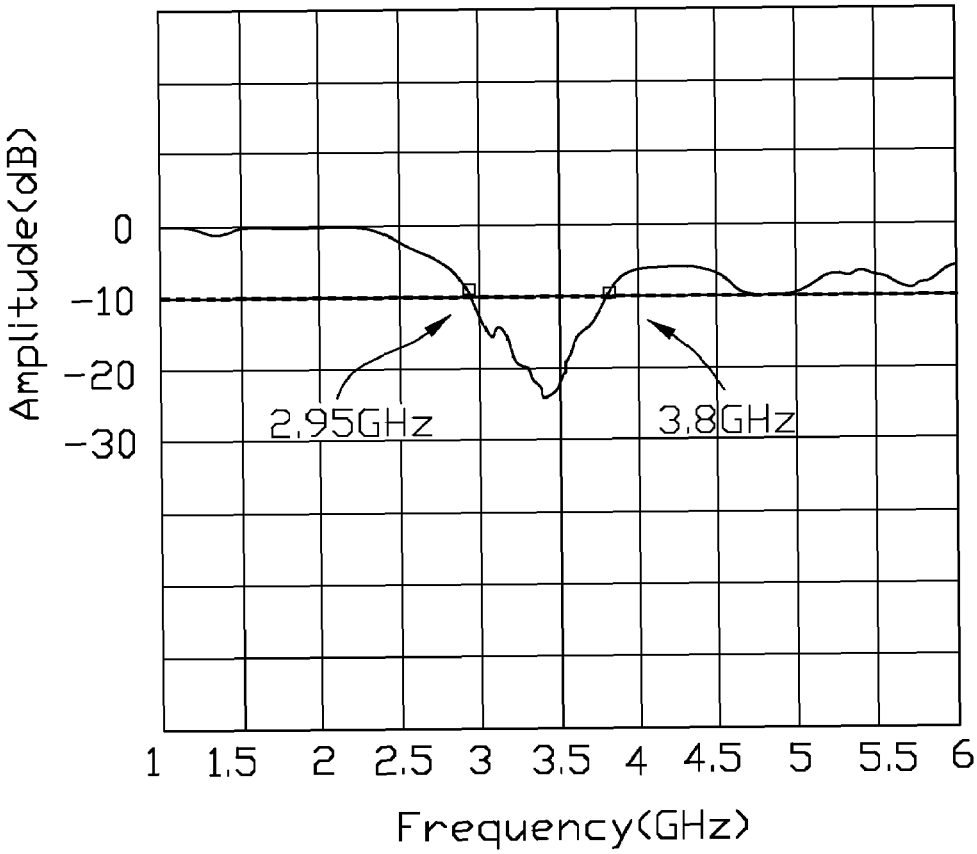
FIG. 2 is a graph of test results showing a return loss of the printed antenna of FIG. 1.

FIG. 2 is a graph of test results showing a return loss of the printed antenna 10 of FIG. 1. As shown, when the printed antenna 10 is operated at frequencies of 3.3-3.8 GHz of the WiMAX standard, return losses drop below −10 dB, which satisfactorily meet normal practical requirements.

Figure 3:
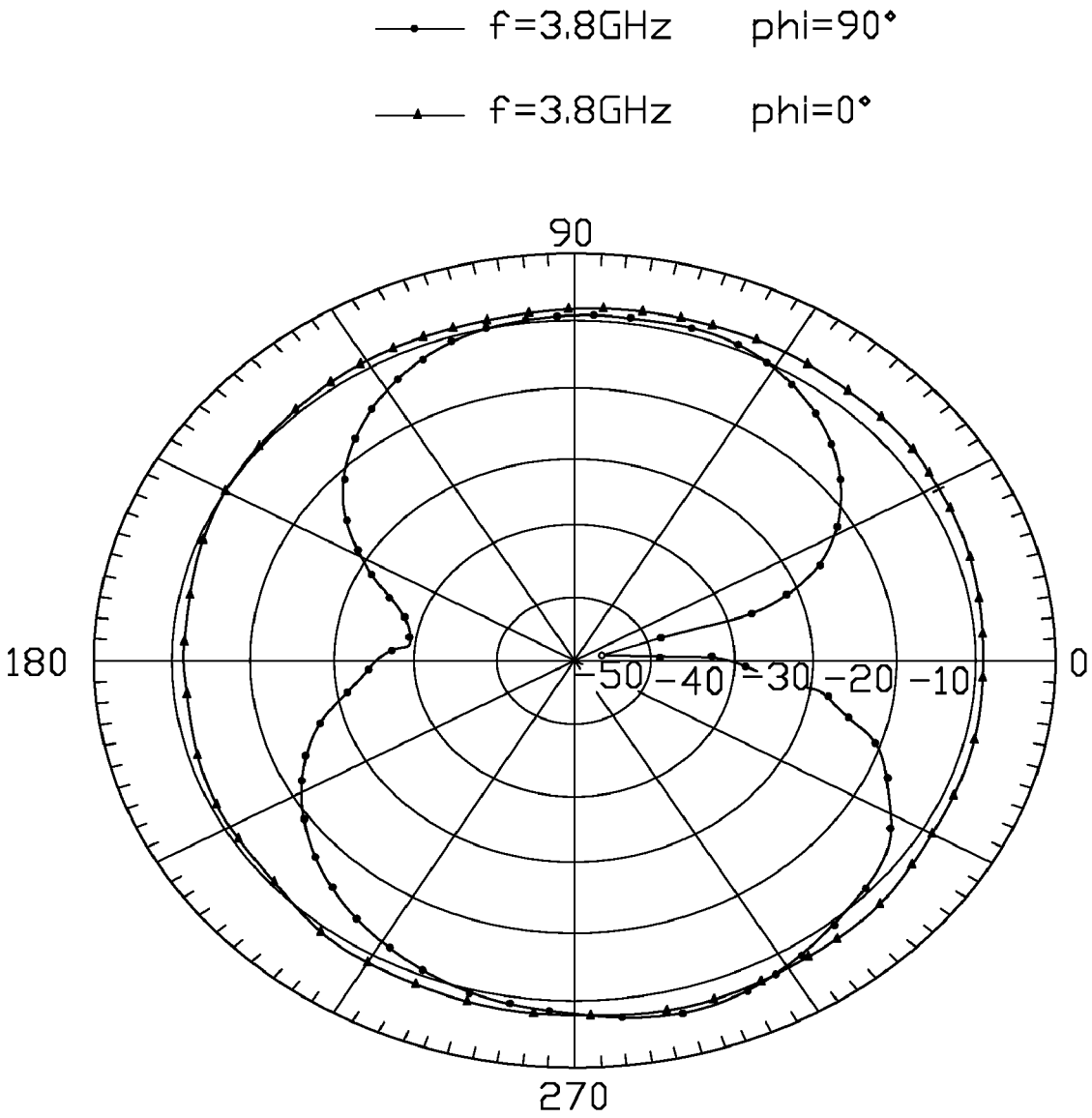
FIG. 3 is a graph of simulated results showing radiation patterns at phi angles of 0 and 90 degrees when the printed antenna of FIG. 1 is operated at 3.8 GHz.
Figure 4:
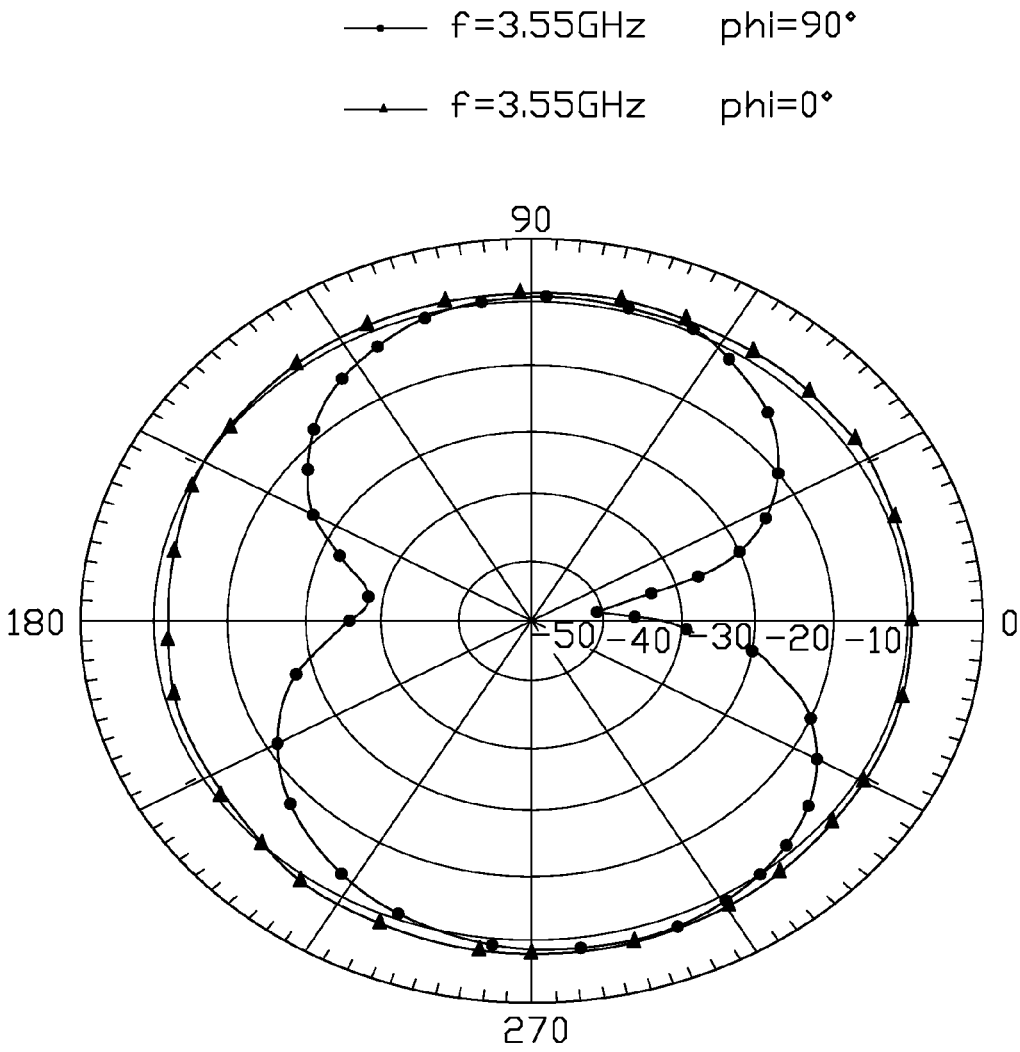
FIG. 4 is a graph of simulated results showing radiation patterns at phi angles of 0 and 90 degrees when the printed antenna of FIG. 1 is operated at 3.55 GHz.
Figure 5:
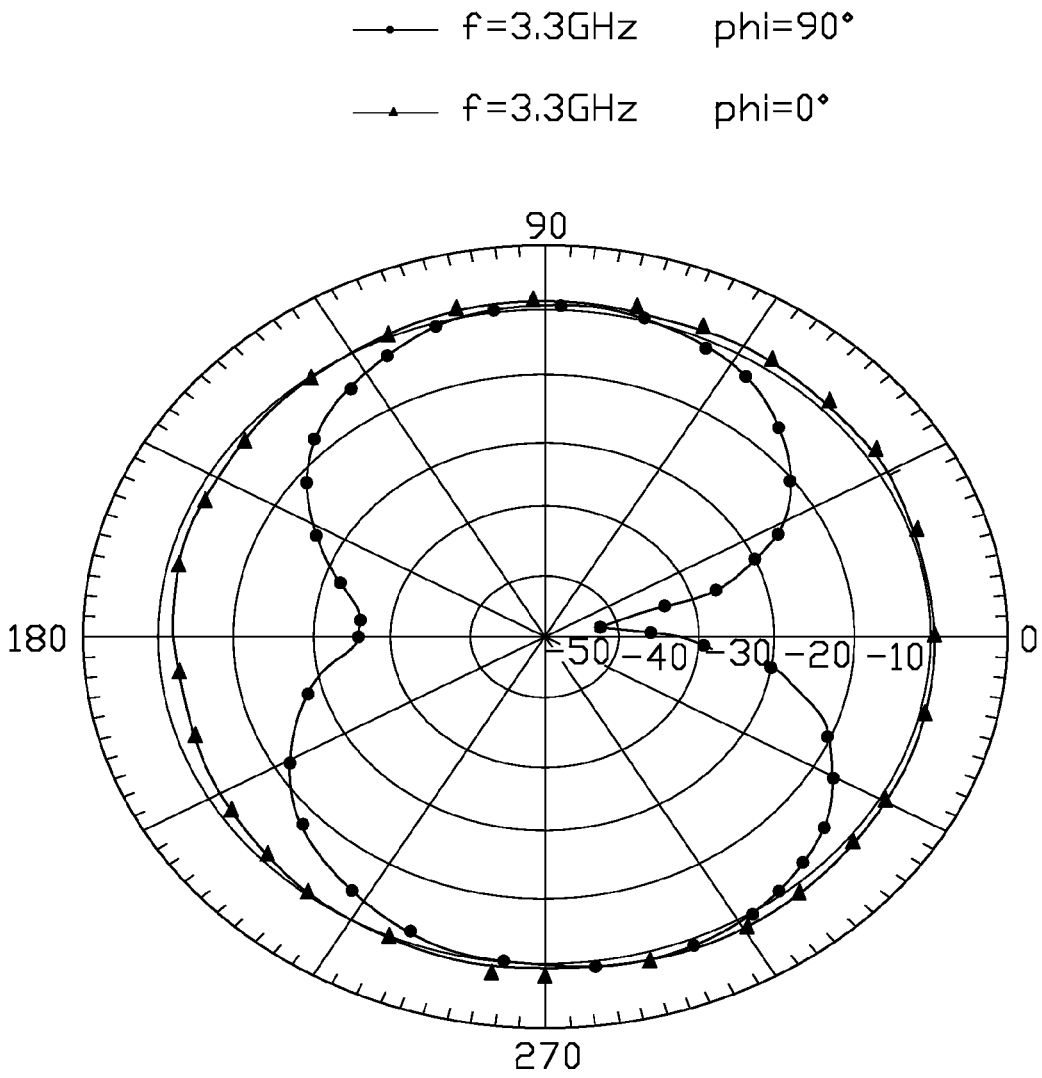
FIG. 5 is a graph of simulated results showing radiation patterns at phi angles of 0 and 90 degrees when the printed antenna of FIG. 1 is operated at 3.3 GHz.

FIGS. 3-5 are graphs of test results showing radiation patterns when the printed antenna 10 of FIG. 1 is operated at 3.8 GHz, 3.55 GHz, and 3.3 GHz respectively. As seen, all of the radiation patterns are substantially omni-directional.

Figure 6:
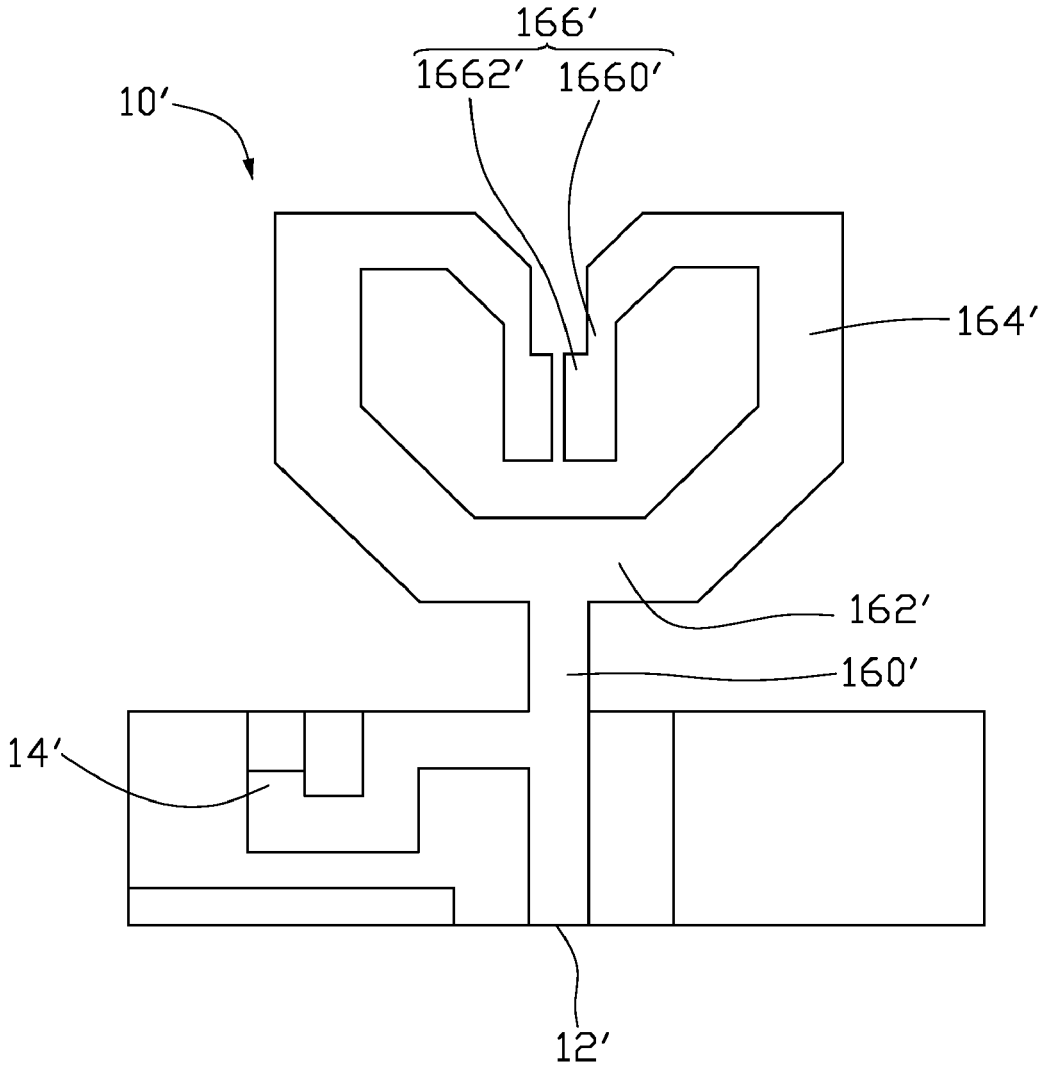
FIG. 6 is a schematic diagram of a printed antenna of another exemplary embodiment of the present invention.

FIG. 6 is a schematic diagram of a printed antenna 10' of another exemplary embodiment of the present invention. The printed antenna 10' is similar to the printed antenna 10, and the difference therebetween is in that the printed antenna 10' does not include the fourth radiation portion 168 of the printed antenna 10. In addition, the shape of the third radiation portion 166' is different from that of the third radiation portion 166, and the distance between the third radiation portions 166' is different from the distance between the third radiation portions 166. Each third radiation portion 166' includes a fifth radiation segment 1660' and a sixth radiation segment 1662' electronically connected to the fifth radiation segment 1660'. The fifth radiation segments 1660' of the pair of third radiation portions 166 are parallel to each other, and the sixth radiation segments 1662' of the pair of third radiation portions 1662' are parallel to each other. In this embodiment, widths of the sixth radiation segments 1662' are greater than those of the fifth radiation segments 1660'. Each fifth radiation segment 1660' is electronically connected to the second radiation portions 164'. The pair of sixth radiation segments 1662' have free ends facing each other, and produce coupling effects via the distance therebetween. In the exemplary embodiment, the fifth radiation segment 1660' is trapezoidal-shaped, and the sixth radiation segments 1662' is rectangular-shaped.

In the exemplary embodiment, the distance between the pair of sixth radiation segments 1662' is substantially 0.2 mm, and the distance between the pair of fifth radiation segments 1660' is substantially 1.0 mm. The top length of the fifth radiation segments 1660' is substantially 0.5 mm, and the bottom length is substantially 1.5 mm, and the height is substantially 0.5 mm. The sixth radiation segments 1662' is substantially 2.0 mm long and 0.9 mm wide.

In another exemplary embodiment, the matching portion 14' may be in a line and rectangular-shaped. The matching portion 14' may be substantially 6.0 mm long and 1.0 mm wide.

Figure 7:
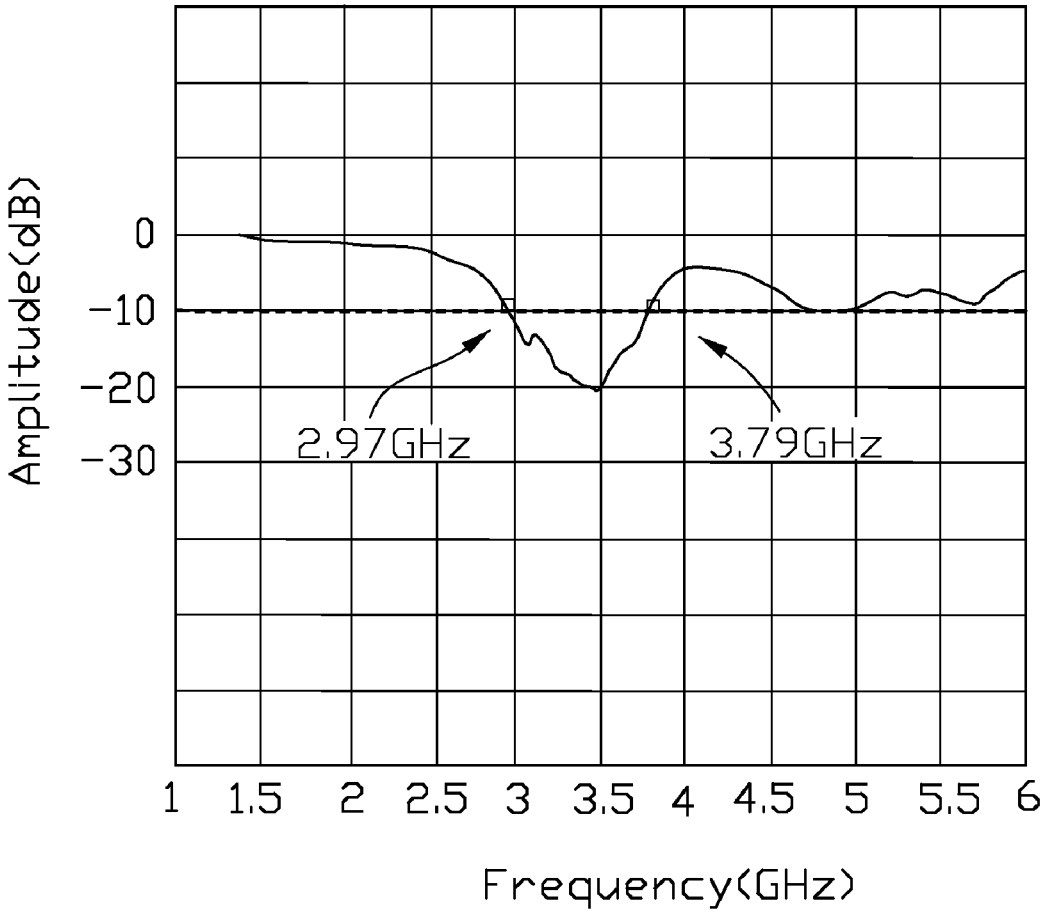
FIG. 7 is a graph of test results showing a return loss of the printed antenna of FIG. 6.

FIG. 7 is a graph of test results showing a return loss of the printed antenna 10' of FIG. 6. As shown, when the printed antenna 10' is operated at frequencies of 3.3-3.8 GHz of the WiMAX standard, return losses drop below −10 dB.

In the exemplary embodiment, the lengths of the antenna bodies 16 and 16' are both one half of the working wavelength of the radio frequency signal, and lengths of the matching portions 14 and 14' are both one quarter of the working wavelength.

In the exemplary embodiment of the invention, due to the antenna bodies 16 and 16' and the matching portions 14 and 14' the printed antennas 10 and 10' have smaller sizes.

While various embodiments and methods of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A printed antenna, disposed on a substrate, comprising:

a feeding portion, for feeding electromagnetic signals;

an antenna body, electronically connected to the feeding portion, for transmitting and receiving electromagnetic signals, the antenna body comprising a first radiation portion, a pair of second radiation portions, and a pair of third radiation portions, each second radiation portion respectively connecting one of the third radiation portions to the first radiation portion, and two free ends of the pair of third radiation portions facing each other, the first radiation portion, the pair of second radiation portions, and the pair of third radiation portions co-forming a "D" shape, with an indentation in a straight side of the "D" shape which extends into a middle of the "D" shape;

a first grounded portion, disposed on one side of the feeding portion;

a second grounded portion, disposed on the other side of the feeding portion; and a matching portion, disposed on one side of the feeding portion, and located adjacent to the first grounded portion.

2. The printed antenna as claimed in claim 1, wherein the pair of second radiation portions are symmetrical to each other along an extending line of the feeding portion.

3. The printed antenna as claimed in claim 2, wherein the pair of third radiation portions are symmetrical to each other along the extending line of the feeding portion.

4. The printed antenna as claimed in claim 1, wherein a length of the first grounded portion along the feeding portion is less than that of the second grounded portion along the feeding portion.

5. The printed antenna as claimed in claim 1, wherein the first radiation portion is perpendicular to the feeding portion.

6. The printed antenna as claimed in claim 5, wherein each second radiation portion comprises a first radiation segment, a second radiation segment, a third radiation segment, and a fourth radiation segment, and all the radiation segments are electronically connected in sequence.

7. The printed antenna as claimed in claim 6, wherein the first radiation segments of the second radiation portions are electronically connected to two ends of the first radiation portion respectively.

8. The printed antenna as claimed in claim 7, wherein as far as each second radiation portion is concerned, the first radiation segment is parallel to the fourth radiation segment, and the second radiation segment is perpendicular to the third radiation segment.

9. The printed antenna as claimed in claim 8, wherein an angle between the first radiation segment and the second radiation segment and an angle between the third radiation segment and the fourth radiation segment are both substantially 135 degrees.

10. The printed antenna as claimed in claim 7, wherein the angle between each first radiation segment and the first radiation portion and the angle between the fourth radiation segment and the third radiation portion are both substantially 135 degrees.

11. The printed antenna as claimed in claim 1, wherein the antenna body further comprises a fourth radiation portion with two ends electronically connected to two free ends of the pair of third radiation portions respectively.

12. The printed antenna as claimed in claim 1, wherein the pair of third radiation portions produce coupling effects via a distance therebetween.

13. The printed antenna as claimed in claim 1, wherein the antenna body further comprises a connection portion electronically connected to the substantial center of the first radiation portion and the feeding portion.

14. The printed antenna as claimed in claim 13, wherein the connection portion is perpendicular to the first radiation portion, and is in a line with the feeding portion.

15. The printed antenna as claimed in claim 1, wherein the matching portion comprises a first matching segment, a second matching segment, a third matching segment, and a fourth matching segment, and all the matching segment are electronically connected in sequence.

16. The printed antenna as claimed in claim 15, wherein the first matching segment is electronically connected to the feeding portion.

17. The printed antenna as claimed in claim 16, wherein the first matching segment is parallel to the third matching segment, the second matching segment is parallel to the fourth matching segment, and the second matching segment and the fourth matching segment are perpendicular to the first matching segment and the third matching segment.

18. The printed antenna as claimed in claim 1, wherein the matching portion is in a rectangular-shape.

19. A printed antenna disposed on a substrate with two opposite surfaces, the printed antenna comprising:

a feeding portion for feeding electromagnetic signals;

an antenna body, electronically connected to the feeding portion, for transmitting and receiving electromagnetic signals, the antenna body being in a "D" shape, with an indentation in a straight side of the "D" shape which extends into a middle of the "D" shape;

a first grounded portion, disposed on one side of the feeding portion;

a second grounded portion, disposed on the other side of the feeding portion; and a matching portion, disposed on one side of the feeding portion, and located adjacent to the first grounded portion.

20. An antenna assembly, comprising:

a substrate; and an antenna formed on a surface of said substrate, said antenna comprising a feeding portion for feeding electromagnetic signals, a matching portion electrically connectable to said feeding portion and disposed at one side of said feeding portion, and an antenna body electrically connectable to said feeding portion beside said matching portion for transmitting and receiving said electromagnetic signals, said antenna body comprising a pair of hollow ear-like members symmetrically to each other relative to said feeding portion.

* * * * *